United States Patent [19]

Barr

[11] Patent Number: 4,966,317

[45] Date of Patent: Oct. 30, 1990

[54] DEVICE FOR DISPENSATION OF COMPRESSED GAS

[76] Inventor: Phillip Barr, 618 E. 82nd St., Brooklyn, N.Y. 11236

[21] Appl. No.: 373,189

[22] Filed: Jun. 28, 1989

[51] Int. Cl.[5] ..... B67B 7/49

[52] U.S. Cl. ..... 222/5; 222/83.5; 222/402.1

[58] Field of Search ..... 222/5, 402.1, 512, 518, 222/83, 83.5, 88, 46; 239/309; 137/801; 30/1.5, 443

[56] References Cited

U.S. PATENT DOCUMENTS

| | | | |
|---|---|---|---|
| 3,291,341 | 12/1966 | Simmons | 222/5 X |
| 3,472,292 | 10/1969 | Godfrey | 222/5 X |
| 3,517,932 | 6/1970 | Clinkscales | 222/5 X |
| 3,789,861 | 2/1974 | Conn et al. | 222/5 X |
| 3,905,755 | 9/1975 | Aske | 222/5 X |
| 4,086,062 | 4/1978 | Hach | 222/46 X |

*Primary Examiner*—Andres Kashnikow
*Assistant Examiner*—Kenneth DeRosa
*Attorney, Agent, or Firm*—Iman Abdallah

[57] ABSTRACT

A portable device for dispensation of compressed gas in discrete bursts. The device includes a support frame, a cylinder punch assembly, an adjustable cylinder table, a rotatable knob to adjust the table and a trigger-operated nozzle. The punch assembly permits puncture of a cylinder of compressed gas that is supported on the adjustable cylinder table.

5 Claims, 1 Drawing Sheet

DEVICE FOR DISPENSATION OF COMPRESSED GAS

BACKGROUND OF THE INVENTION

The present invention generally relates to means for inflating flaccid toys, devices and the like. In particular, the present invention relates to devices for dispensation of compressed gases for inflation purposes.

Compressed gas is used throughout the prior art for inflation purposes. Various means are utilized for dispensation in a controlled manner. Primarily, controlled dispensation is achieved by gradual variation of the area of passageway from a cylinder of gas thereby permitting a varying stream of gaseous flow. Devices of this type do not readily permit the passage of discrete bursts of gas from the cylinder.

Devices known in the prior art which do provide means for passage of discrete bursts of compressed gas generally comprise complicated nozzle assemblies, attachable and usable with large cylinders of compressed gas. Such devices are unsuitable for portable and small quantity uses. Furthermore, these devices are dangerous and require special care and knowledge for their safe use.

SUMMARY OF THE INVENTION

The invention of the present disclosure provides a portable dispensation device for use with small cylinders of compressed gas. The present device generally comprises a hand-held support frame including an adjustable cylinder table for support of a cylinder of gas, a cylinder punch assembly providing means to puncture the cylinder of gas and a trigger-operated nozzle for selective dispensation of gas in discrete bursts.

An object of this invention is to provide a portable inflation device for dispensation of compressed gas from small cylinders.

Another object of the present invention is to provide a device for dispensation of compressed gas in discrete bursts.

These and other objects and advantages of the present invention will be apparent to those skilled in the art from the following drawings, description of a preferred embodiment and claims.

PREFERRED EMBODIMENT OF THE INVENTION

Figure 1:
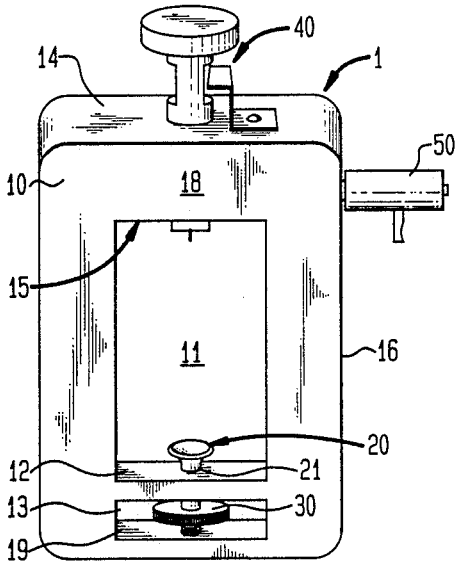
FIG. 1 is a side perspective view of the dispensation device of the present invention.

FIG. 1 illustrates in a side perspective view the dispensation device 1 of the present invention. The dispensation device 1 generally comprises a rectangular support frame 10, an adjustable cylinder table 20, cylinder adjustment means 30, cylinder punch assembly 40, and a trigger-operated nozzle 50. The support frame 10 has a central cavity 11 formed therein which extends to each side of frame 10. Adjustable cylinder table 20 is disposed within said central cavity 11 and includes a table stem 21 which extends through the bottom wall 12 of said central cavity 11 to the cylinder adjustment means 30. Cylinder adjustment means 30 is disposed below the central cavity 11 within an adjustment means cavity 13 which likewise extends to each side of frame 10. Cylinder punch assembly 40 is disposed at the top surface 14 of support frame 10 and extends therethrough to the top wall 15 of said cylinder cavity 11. Trigger-operated nozzle 50 is disposed in a side wall 16 at the top portion 18 of frame 10.

Figure 2:
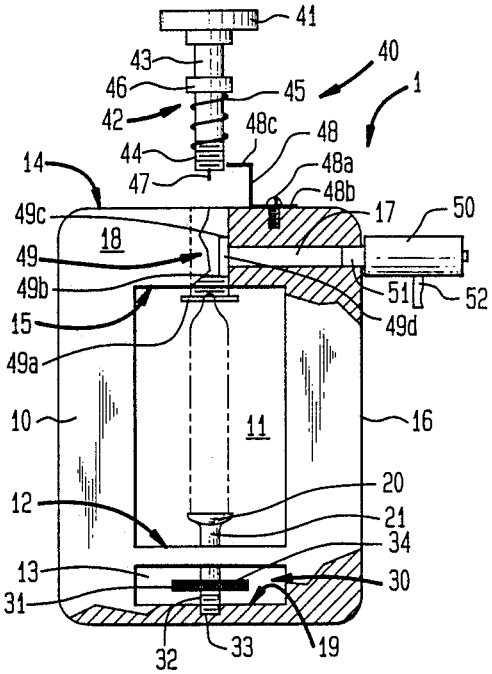
FIG. 2 is a partially exploded fragmentary side plan view of the device of the present invention.

In the side plan view of the device 1 shown in FIG. 2 it can be seen that cylinder punch assembly 40 and nozzle 50 communicate by means of a horizontally-extending gas chamber 17 formed within the top portion 18 of frame 10 as described below in greater detail. Cylinder punch assembly 40 generally comprises an engagement arm 42 and an engagement sleeve 49. Knob 41 is formed at the top portion of the engagement arm 42 and is integrally constructed with a downwardly-extending, substantially cylindrical portion having a peripheral recession 43 formed proximate to the knob 41 and threads 44 formed at its distal end. An expansion-bias spring 45 is peripherally disposed about the cylindrical portion below the lower lip 46 of the recession 43 and above the threads 44 formed at the distal end to facilitate operation of cylinder punch assembly 40. Punch assembly 40 further includes a needle 47 integrally formed with and extending from the distal end of engagement arm 42 which provides means to puncture the cylinder of compressed gas (shown by the broken lines) that is to be used in conjunction with the device 1. A Z-shaped stop 48 is attached to the top wall 14 of frame 10 adjacent to engagement arm 42 by means of a screw **48*a* which passes through the lower leg 48*b* of stop 48 and engages frame 10. Stop 48 is disposed in a manner to permit the upper leg 48*c* of stop 48 to extend within the recession 43 of the engagement arm 42 (FIG. 1) of punch assembly 40. Engagement arm 42 attaches to frame 10 by threaded engagement with punch engagement sleeve 49. Punch engagement sleeve 49 is disposed within the top portion 18 of frame 10 extending from the top wall 15 of central cavity 11 to the top wall 14 of frame 10 and includes upper and lower orifices. Sleeve rim 49*a* fits snugly against the top wall 15 of central cavity 11 to facilitate the sealingly engagement of sleeve 49 with frame 10. Sleeve threads 49*b* are formed in the inner wall 49*c* of engagement sleeve 49 adjacent to sleeve rim 49*a* and are complimentarily formed with the threads 44 formed at the distal end of engagement arm 42 for threadedly attachment thereto. Sleeve 49 further includes a slotted opening 49*d* formed in sleeve wall 49*c* which communicates with the gas chamber 17 that is formed in the top portion 18 of frame 10**.

Cylinder table 20 is a substantially bowl-shaped member having an integrally constructed stem 21 which extends through the bottom wall 12 of central cavity 11 to cylinder adjustment means 30. The lower end of stem 21 is integrally formed with rotatable dial 31 of the adjustment means 30 which includes a dial extension 32 having a threaded outer wall, said threads being complimentary with the threads of an adjustment means engagement slot 33 formed in the floor 19 of the lower adjustment means cavity 13. Rotatable dial 31 includes vertical ridges 34 formed along its periphery to facilitate manual adjustment of the cylinder adjustment means 30. A cylinder of compressed gas, shown by the broken lines in FIG. 2, is placed within the cylinder table 20 and adjusted upwardly by rotation of the dial 31 so that the mouth of the cylinder extends into the interior of sleeve 49.

Trigger-operated nozzle 50 communicates with the cylinder of compressed gas via the slotted opening 49*d* of sleeve 49 and the horizontally-extending chamber 17 formed in the upper portion 18 of frame 10. Nozzle 50 includes an attachment extension 51 which sealingly engages chamber 17 at the side wall 16 of frame 10. Squeezing of the nozzle trigger 52 permits selective dispensation of the compressed gas in discrete bursts.

Figure 3:
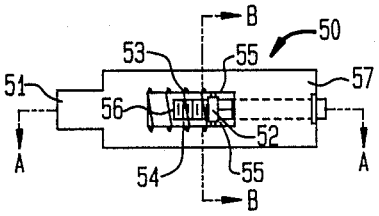
FIG. 3 is a bottom plan view of the nozzle portion of the device.
Figure 4:
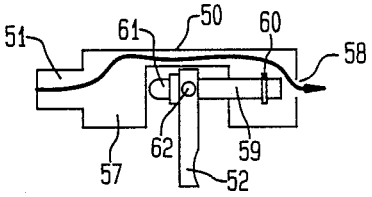
FIG. 4 is a cross-sectional view of the nozzle portion of the device taken along line A—A of FIG. 3.
Figure 5:
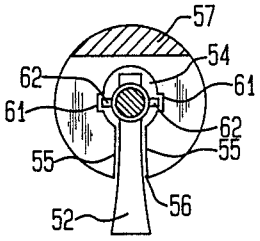
FIG. 5 is a cross-sectional view of the nozzle portion of the device taken along line B—B of FIG. 3.

FIGS. 3, 4 and 5 illustrate the details of a preferred embodiment of the nozzle 50 of the present invention. As shown in the bottom plan view in FIG. 3 nozzle 50 includes an extension-biased spring 53 disposed at the rear of nozzle trigger 52. Spring 53 is disposed within a trigger cavity 54 and is held in place therewithin by the lower lips 55 of trigger cavity 54 which form a more narrowly constructed trigger slot 56 through which the nozzle trigger 52 protrudes outwardly (FIGS. 4 and 5). The extension-biased spring 53 provides means to return the trigger 52 to its closed position. In the cross-sectional view of nozzle 50 shown in FIG. 4 it can be seen that the main body 57 of nozzle 50 is hollow providing a gas flow passageway, as shown by the arrow, from the nozzle extension 51 to the nozzle outlet 58. Trigger 52 is fixedly attached to a trigger tongue 59 which extends through nozzle outlet 58 when the trigger 52 is in its closed position. A ring seal 60 is integrally formed peripherally about tongue 59 proximate to the distal end of tongue 59 to facilitate containment of the gas when the trigger 52 is in its closed position. Horizontally-extending slots 61 are formed in the vertical walls of trigger cavity 54 to which trigger 52 is slidably attached by means of trigger arms 62 (FIG. 5).

Operation of the dispenser device 1 is achieved by simply pulling the trigger 53 backwards. The cylinder of compressed gas that is to be used with the device 1 is first placed in the cylinder table 20 and adjusted upwardly by rotation of cylinder adjustment dial 31 until the mouth of the cylinder snugly engages the lower orifice of sleeve 49. The knob 41 of punch assembly 40 is then manually rotated to engage the threads 44 of engagement arm 42 with the threads 49*b* of sleeve 49. Rotation of knob 41 is continued until the needle 47 of punch assembly 40 punctures the cylinder forming an opening therein. Knob 41 is then rotated in the opposite direction to move the punch assembly 40 away from the cylinder thereby allowing the gas contained therein to escape from the cylinder through the sleeve slot 49*d* of sleeve 49 to the chamber 17 of frame 10. The gas from the cylinder then fills the hollow body 57 of nozzle 50, said gas being releasable in discrete bursts as desired by pulling the trigger 52 of nozzle 50 backwards thereby releasing the nozzle tongue 59 from the nozzle opening 58 permitting the gas to escape. Continual flow of gas through opening 58 can be achieved by holding trigger 52 in its pulled position. The extension-biased spring 53 causes trigger 52 and the attached tongue 59 to return to the closed position when trigger 52 is released.

In view of the foregoing, what is claimed is:

1. A portable compressed gas dispensation device for use with a small cylinder of compressed gas, said dispensation device comprising a support frame having a first cavity formed at the central portion of said frame and a second cavity formed in said frame below said central cavity; a cylinder punch assembly disposed in the top portion of said frame, said punch assembly extending from the top wall of said support frame to said central cavity, said cylinder punch assembly comprising an engagement arm and an engagement sleeve, said engagement arm including a knob and a downwardly-extending cylindrical portion, said cylindrical portion having a peripheral recession formed proximate to said knob and threads formed at its distal end, said engagement arm further including a needle integrally formed with an extending from its distal end, said needle providing means to puncture the cylinder of compressed gas used in conjunction with the present device, said engagement sleeve including a sleeve rim formed at its distal end to facilitate sealingly engagement of said sleeve with the top wall of said first cavity of said support frame, said sleeve further including sleeve threads formed in tis inner wall adjacent to sleeve rim, said sleeve threads being complimentarily formed with the threads formed with the threads formed at the distal end of the engagement arm for threadedly attachment thereto, said sleeve still further including a slotted opening formed in the walls thereof above said sleeve threads, said opening providing communication means with the chamber formed in the top portion of said frame; an adjustable cylinder table disposed within said first cavity; cylinder adjustment means disposed within said second cavity and integrally constructed with said cylinder table; and a trigger-operated nozzle disposed to one side of said support frame, said nozzle communicating with the cylinder punch assembly by means of a chamber formed within said support frame.

2. A portable compressed gas dispensation device as described in claim 1 wherein said cylinder table is a substantially bowl-shaped member having an integrally constructed stem which extends through the bottom wall of said first central cavity to said cylinder adjustment means, said stem being integrally constructed with said cylinder adjustment means, said cylinder adjustment means including a rotatable dial integrally constructed with a dial extension having a threaded outer wall, the threads of said dial extension being complimentary with the threads of an adjustment means engagement slot formed in the floor of said second cavity.

3. A compressed gas dispensation device as described in claim 2 wherein the nozzle attaches to said support frame by means of a nozzle extension which snugly fits within said chamber formed within said support frame, said nozzle including a trigger attached to a trigger tongue, said trigger tongue extending through a nozzle outlet when said trigger is closed, said trigger being slidably attached to horizontally-extending slots formed in the walls of said main body within a trigger cavity, said nozzle further including an extension-biased spring disposed within said trigger cavity at the rear of said trigger.

4. A portable compressed gas dispensation device for use in conjunction with a small cylinder of compressed gas, said dispensation device comprising a support frame having a first cavity formed at the central portion of said frame and a second cavity formed in said frame below said central cavity;

a cylinder punch assembly disposed in the top portion of said frame, said punch assembly extending from the top wall of said support frame to said central cavity and comprising an engagement arm and an engagement sleeve, said engagement arm including a knob and a downwardly-extending cylindrical portion, said cylindrical portion having a peripheral recession formed proximate to said knob and threads formed at its distal end, said engagement arm further including a needle integrally formed with and extending from its distal end, said needle providing means to puncture the cylinder of compressed gas used in conjunction with the present device, said engagement sleeve including a sleeve rim formed at its distal end to facilitate sealingly engagement of said sleeve with the top wall of said first cavity of said support frame, said sleeve further including sleeve threads formed in its inner wall adjacent to sleeve rim, said sleeve threads being complimentarily formed with the threads formed at the distal end of the engagement arm for threadedly attachment thereto, said sleeve still further including a slotted opening formed in the walls thereof above said sleeve threads, said opening providing communication means with the chamber formed in the top portion of said frame;

an adjustable cylinder table disposed within said first cavity, said cylinder table comprising a substantially bowl-shaped member having an integrally constructed stem which extends through the bottom wall of said first central cavity to cylinder adjustment means, said stem being integrally constructed with said cylinder adjustment means, said cylinder adjustment means including a rotatable dial integrally constructed with a dial extension having a threaded outer wall, the threads of said dial extension being complimentary with the threads of an adjustment means engagement slot formed in the floor of said second cavity;

cylinder adjustment means disposed within said second cavity and integrally constructed with said cylinder table; and a trigger-operated nozzle disposed to one side of said support frame, said nozzle communicating with the cylinder punch assembly by means of a horizontally-extending chamber formed within said support frame above said first cavity, said nozzle attaching to said support frame by means of a nozzle extension which snugly fits within said chamber, said nozzle including a trigger attached to a trigger tongue, said trigger tongue extending through a nozzle outlet when said trigger is closed, said trigger being slidably attached to horizontally-extending slots formed in the walls of said main body within a trigger cavity, said nozzle further including an extension-biased spring disposed within said trigger cavity at the rear of said trigger.

5. A compressed gas dispensation device as described in claim 4 wherein said cylinder punch assembly includes an extension-biased spring peripherally disposed about the cylindrical portion of said engagement arm and a Z-shaped stop attached at the top wall of said support frame adjacent to said engagement arm by means of a screw which passes through the lower leg of said stop and engages said support frame, said stop being disposed in a manner to permit the upper leg thereof to extend within the recession of the cylindrical portion of said engagement arm.

* * * * *